US008899260B2

(12) United States Patent
Kurushima

(10) Patent No.: US 8,899,260 B2
(45) Date of Patent: Dec. 2, 2014

(54) CONSTRUCTION MACHINE

(75) Inventor: Satoshi Kurushima, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 943 days.

(21) Appl. No.: 13/040,688

(22) Filed: Mar. 4, 2011

(65) Prior Publication Data

US 2011/0226348 A1 Sep. 22, 2011

(30) Foreign Application Priority Data

Mar. 18, 2010 (JP) ..... 2010-062016

(51) Int. Cl.
*E02F 9/00* (2006.01)
*E02F 9/08* (2006.01)
*E02F 9/22* (2006.01)

(52) U.S. Cl.
CPC ..... *E02F 9/08* (2013.01); *E02F 9/2275* (2013.01)
USPC ..... 137/354; 248/56

(58) Field of Classification Search
CPC ..... E02F 9/0883; E02F 9/0866; E02F 9/2275
USPC ..... 137/355.12, 351, 354, 899; 248/49, 56; 37/466
See application file for complete search history.

(56) References Cited

U.S. PATENT DOCUMENTS

| | | | | |
|---|---|---|---|---|
| 7,416,219 | B2 * | 8/2008 | Sato et al. | 280/830 |
| 2004/0261299 | A1 * | 12/2004 | Murakami | 37/347 |
| 2005/0166429 | A1 * | 8/2005 | Tanaka et al. | 37/466 |
| 2006/0230650 | A1 * | 10/2006 | Murakami et al. | 37/466 |

FOREIGN PATENT DOCUMENTS

| | | |
|---|---|---|
| JP | 2004-257333 | 9/2004 |
| JP | 3662784 B2 | 6/2005 |

OTHER PUBLICATIONS

Machine Translation of 2004-257333.*
Combined Office Action and Search Report issued Apr. 2, 2014 in Chinese Patent Application No. 201110074291.5 with partial English language translation and English Translation of Category of Cited References.

* cited by examiner

*Primary Examiner* — Kevin Murphy
(74) *Attorney, Agent, or Firm* — Oblon, Spivak, McClelland, Maier & Neustadt, L.L.P.

(57) ABSTRACT

Left and right first and second vertical plates 11, 12, and a partition plate 13 are provided on an upper frame 7. The space above the upper frame 7 is divided into a front section S1 and a rear section S2 by the partition plate 13. A cabin 8 is provided on the left side in the front section S1, and a hydraulic oil tank 16 is provided on the right side in the front section S1. A hydraulic pump 15 is provided on the left side in the rear section S2. A pump suction pipeline 24 is connected from the hydraulic pump 15 in the rear section S2, is entered into the front section S1 while passing through the first vertical plate 11 and the partition plate 13, without passing below the cabin 8, and is connected to the hydraulic oil tank 16. Further, a cover plate 30 is fixed to the outer periphery of the pump suction pipeline 24. A partition-plate-side through-hole 29 is covered, and simultaneously, the pump suction pipeline 24 is supported by attaching the cover plate 30 to the partition plate 13.

9 Claims, 6 Drawing Sheets

CONSTRUCTION MACHINE

BACKGROUND OF THE INVENTION

1. Field of the Invention

The present invention relates to a construction machine, such as a hydraulic shovel, provided with a pump suction pipeline for connecting between a hydraulic pump and a tank disposed anterior and posterior to a partition plate.

2. Description of the Background Art

The background art is described by an exemplified hydraulic shovel.

As shown in FIG. 6, a hydraulic shovel is provided with a crawler-type lower propelling body 1, an upper slewing body 2 slewably mounted on the lower propelling body 1, and a working attachment 6 attached to the upper slewing body 2. The working attachment 6 includes a boom 3, an arm 4, and a bucket 5.

The upper slewing body 2 is provided with an upper frame 7 serving as a base for mounting the working attachment 6 thereon, a cabin 8 loaded on the upper frame 7, a guard member 9, such as a guard panel, which is provided at a rear portion of the upper frame 7, vertical plates 11, 12, and a partition plate 13 provided on the upper frame 7, an engine 14 provided behind the partition plate 13, a hydraulic pump 15 to be driven by the engine 14, a hydraulic oil tank 16 provided on the front side of the partition plate 13, a pump suction pipeline 17 for connecting between the hydraulic pump 15 and the hydraulic oil tank 16, and a hose holder 23 for supporting the pump suction pipeline 17. An engine room 10 is disposed between the guard member 9 and the upper frame 7.

The hydraulic shovel is described by using front and rear directions, and left and right directions, based on the premise that the position of the cabin 8 is set on the left side and on the front side of the upper frame 7.

As described in detail in FIG. 7, the left vertical plate 11 and the right vertical plate 12 extend in the front and rear directions substantially over the entire length of the upper frame 7. The partition plate 13 extends in the left and right directions in such a manner that the partition plate 13 intersects with intermediate portions of the vertical plates 11 and 12 in the front and rear directions.

The space above the upper frame 7 is divided into a front section S1 and a rear section S2 by the partition plate 13. The engine room 10 is disposed in the rear section S2.

In the rear section S2 (in the engine room 10), there are provided an engine 14 which is disposed along the left and right directions, and a hydraulic pump 15 which is disposed on one of the left and right sides (normally, on the left side, hereinafter, an example is described based on the arrangement that the hydraulic pump is disposed on the left side) of the engine 14, and which is driven by the engine 14.

The cabin 8 is loaded on the left side (on the side where the pump is installed) in the front section S1. The hydraulic oil tank 16 is installed on the side (on the right side) opposite to the cabin 8 in the front section S1. The hydraulic pump 15 and the hydraulic oil tank 16 are connected to each other by the pump suction pipeline 17.

Many other parts and devices are disposed in the front section S1 and in the rear section S2. However, since these parts and devices are not related to the present invention, description thereof is omitted herein in FIG. 7.

Conventionally, the pump suction pipeline 17 is provided with a flexible pump-side hose 18 connected to the hydraulic pump 15, a flexible tank-side hose 19 connected to the hydraulic oil tank 16, and a non-flexible connection tube 20 (a metal pipe such as a steel pipe) for connecting between the hoses 18 and 19. The pump suction pipeline 17 is disposed along a path from the hydraulic pump 15 to the hydraulic oil tank 16 while passing the left side (below the cabin) of the front section S2.

FIG. 8 is a diagram schematically showing the disposition of the devices, and the path of the pump suction pipeline 17.

Referring to FIGS. 7 and 8, the partition plate 13 is formed with a partition-plate-side through-hole 21, and the left vertical plate 11 is formed with a vertical-plate-side through-hole 22. Further, as shown in FIG. 7, the hose holder 23 is adapted to fix the intermediate portion (the connection tube) 20 of the pump suction pipeline 17 to the partition plate 13.

A prior art document showing a construction machine equipped with the conventional pump suction pipeline 17 has not been available so far. However, Japanese Unexamined Patent Publication No. 2004-257333 discloses a related art having a pipeline which passes through a partition plate of an upper frame in the similar manner as described above.

In the construction machine equipped with the conventional pump suction pipeline, as described above, the pump suction pipeline 17 is disposed in such a manner that the pump suction pipeline 17 extends forward from the left side of the rear section S2, is entered into the front section S1, is bent rightward while passing below the cabin 8, and is connected to the hydraulic oil tank 16. Accordingly, the dwelling environment in the cabin 8 may be deteriorated resulting from heat release or vibrations from the pump suction pipeline 17.

SUMMARY OF THE INVENTION

An object of the invention is to provide a construction machine that enables to suppress an influence of heat release and vibrations from a pump suction pipeline to a cabin.

An aspect of the invention is to provide a construction machine including a lower propelling body; an upper frame which is slewably mounted on the lower propelling body; a pair of a first vertical plate and a second vertical plate which are provided on the upper frame, the first vertical plate and the second vertical plate being disposed in left and right directions of the upper frame, and extending in front and rear directions of the upper frame; a partition plate which extends in the left and right directions and intersects with the first vertical plate and the second vertical plate in such a manner that a space above the upper frame is divided into a front section and a rear section; an engine which is provided along the left and right directions in the rear section; a hydraulic pump which is driven by the engine, at least a portion of the hydraulic pump being disposed in a region of the rear section opposite to the second vertical plate with respect to the first vertical plate; a cabin which is disposed in a region of the front section opposite to the second vertical plate with respect to the first vertical plate; a hydraulic oil tank which is provided in a region of the front section closer to the second vertical plate than the first vertical plate; and a pump suction pipeline which connects between the hydraulic pump and the hydraulic oil tank. In the above arrangement, the first vertical plate is formed with a vertical-plate-side through-hole which passes through a portion of the first vertical plate in the rear section in the left and right directions, the partition plate is formed with a partition-plate-side through-hole which passes through a portion of the partition plate between the first vertical plate and the second vertical plate in the front and rear directions, and the pump suction pipeline is disposed between the front section and the rear section while passing through the vertical-plate-side through-hole and the partition-plate-side through-hole.

These and other objects, features and advantages of the present invention will become more apparent upon reading the following detailed description along with the accompanying drawings.

DETAILED DESCRIPTION OF THE PREFERRED EMBODIMENTS OF THE INVENTION

Figure 1:
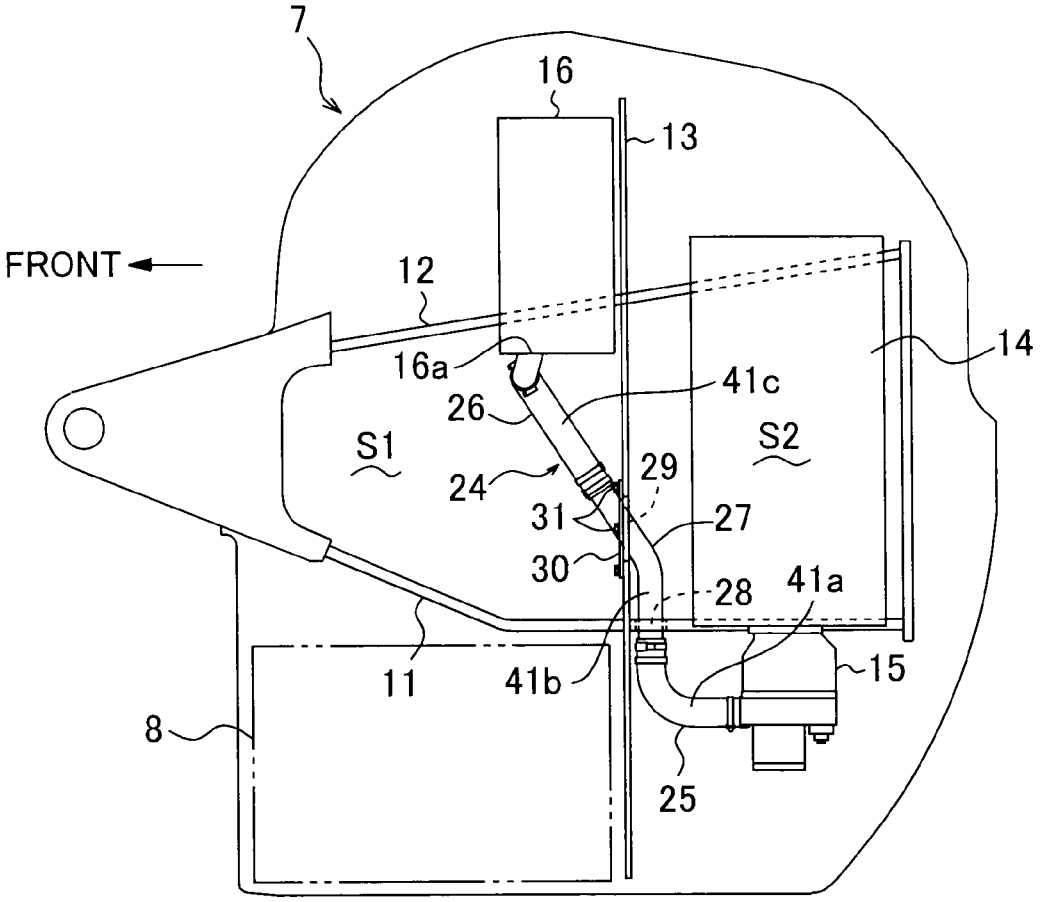
FIG. 1 is a schematically plan view showing a construction machine embodying the invention.

In the following, an embodiment of the invention is described referring to the drawings. The following embodiment is merely an example embodying the invention, and does not limit the technical scope of the invention.

Figure 6:
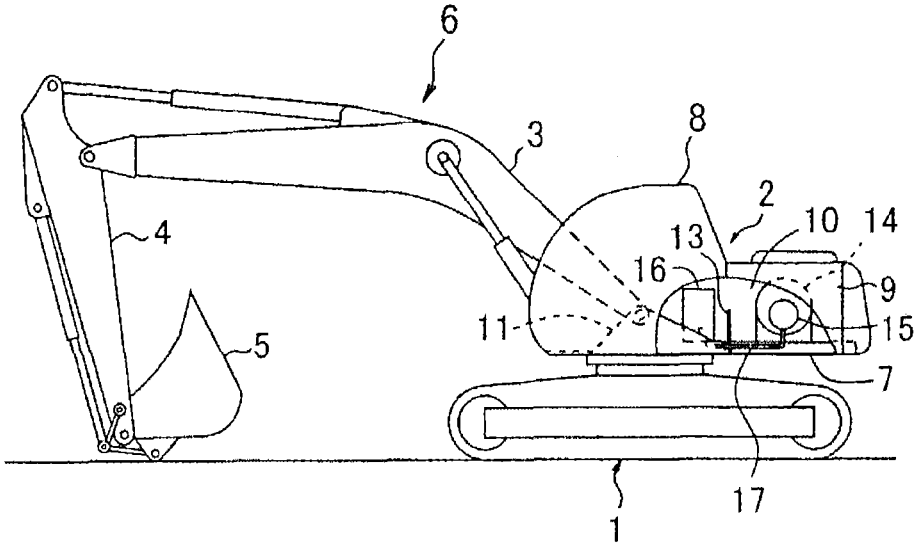
PRIOR ART FIG.6
FIG. 6 is a partially cutaway side view of a hydraulic shovel incorporated with a conventional pump suction pipeline.
Figure 7:
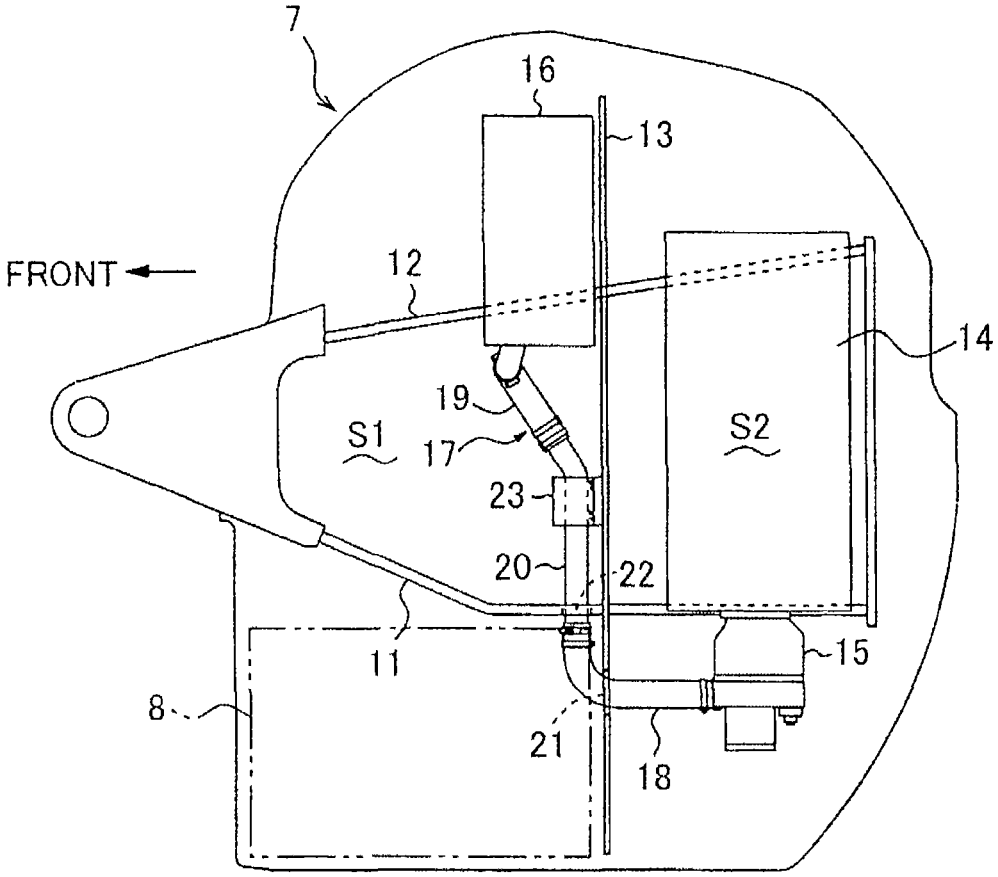
PRIOR ART FIG.7
FIG. 7 is a schematically plan view enlargedly showing a part of a construction machine incorporated with the conventional pump suction pipeline.
Figure 8:
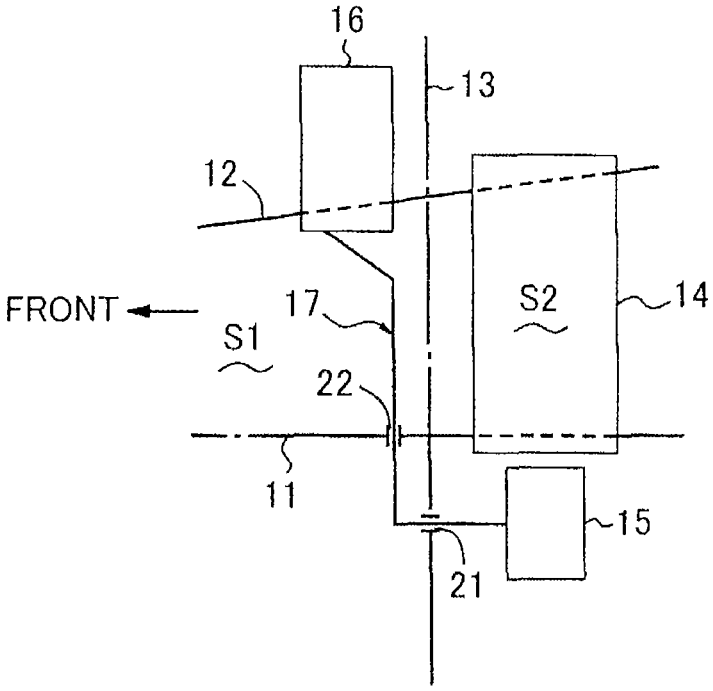
PRIOR ART FIG.8
FIG. 8 is a diagram schematically showing the construction machine incorporated with the conventional pump suction pipeline.

In the embodiment, a hydraulic shovel is described as an example of a construction machine. The basic arrangement of the hydraulic shovel is the same as shown in FIG. 6. Specifically, the hydraulic shovel is provided with a crawler-type lower propelling body 1, an upper slewing body 2 slewably mounted on the lower propelling body 1, and a working attachment 6 attached to the upper slewing body 2. The working attachment 6 includes a boom 3 operable to be raised or lowered with respect to the upper slewing body 2, an arm 4 swingably attached to the boom 3, and a bucket 5 swingably attached to the arm 4.

The upper slewing body 2 includes a cabin 8 serving as a dwelling space for the operator. In the following, the hydraulic shovel is described by using front and rear directions, and left and right directions, based on the premise that the position of the cabin 8 is set on the left side and on the front side of the upper slewing body 2.

Figure 2:
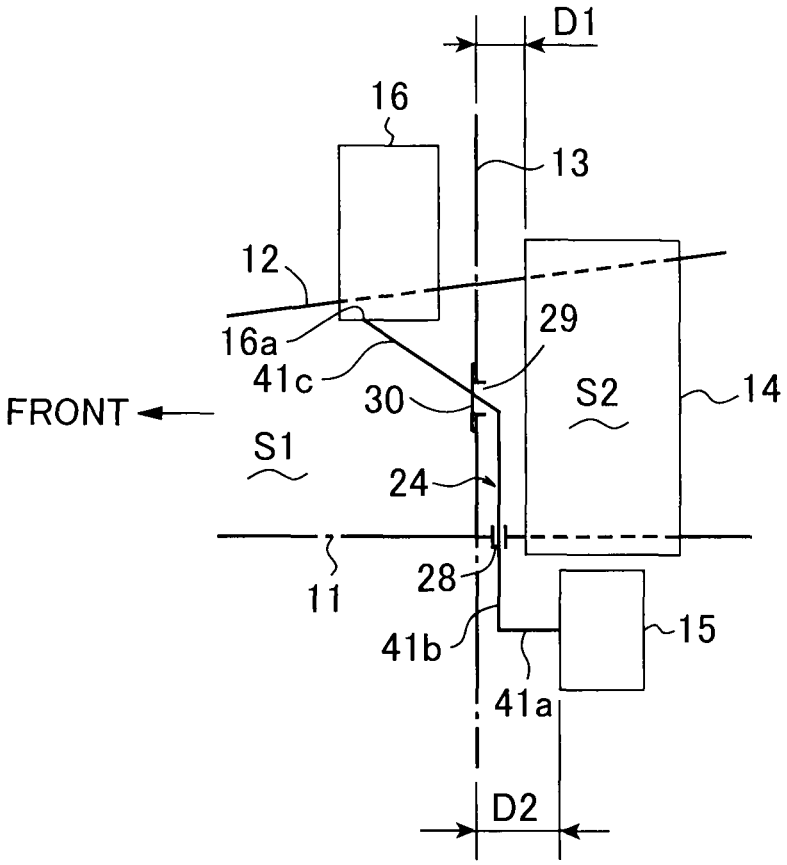
FIG. 2 is a diagram schematically showing the construction machine shown in FIG. 1.

Referring to FIG. 1, FIG. 2, and FIG. 6, the upper slewing body 2 is provided with an upper frame 7 serving as a base and for mounting the working attachment 6 thereon, a pair of a first vertical plate 11 and a second vertical plate 12 provided on the upper frame 7 in a state that the first vertical plate 11 and the second vertical plate 12 are disposed in the left and right directions, and extending in the front and rear directions, a partition plate 13 provided on the upper frame 7 and extending in the left and right directions, an engine 14 provided on a rear portion of the upper frame 7, a hydraulic pump 15 to be driven by the engine 14, the cabin 8 disposed on the front side of the hydraulic pump 15, a hydraulic oil tank 16 disposed on the right side of the cabin 8, a pump suction pipeline 24 for connecting between the hydraulic pump 15 and the hydraulic oil tank 16, a cover plate 30 fixed to the pump suction pipeline 24, and a guard member 9 provided on the rear portion of the upper frame 7 in such a manner as to cover the engine 14. An engine room 10 for housing the engine 14 therein is formed between the guard member 9 and the upper frame 7.

Referring to FIG. 1 and FIG. 2, the first vertical plate 11 and the second vertical plate 12 extend in the front and rear directions substantially over the entire length of the upper frame 7. Front portions of the first vertical plate 11 and the second vertical plate 12 are formed higher than the other portions thereof, and support a base end of the boom 3 to be pivotally raised or lowered. The engine 14 is loaded on rear portions of the first vertical plate 11 and the second vertical plate 12.

The partition plate 13 substantially perpendicularly intersects with intermediate portions of the first vertical plate 11 and the second vertical plate 12 in such a manner that the space above the upper frame 7 is divided into a front section S1 and a rear section S2. The engine room 10 (see FIG. 6) is formed in the rear section S2.

The engine 14 is provided along the left and right directions in the rear section S2. Specifically, the longitudinal direction of the engine 14 is aligned with the left and right directions. Further, the engine 14 is disposed at a position behind the partition plate 13 in such a manner that an engine-front-side clearance D1 (see FIG. 2) is formed between the partition plate 13 and the engine 14.

The hydraulic pump 15 is disposed in a region (a left-side region) opposite to the second vertical plate 12 with respect to the first vertical plate 11. Specifically, the hydraulic pump 15 is connected to a left portion of the engine 14. Further, the hydraulic pump 15 is disposed at a position behind the partition plate 13 in such a manner that a pump-front-side clearance D2 (see FIG. 2) is formed between the partition plate 13 and the hydraulic pump 15. In the embodiment, the entirety of the hydraulic pump 15 is disposed on the left side of the second vertical plate 12. Alternatively, at least a portion of the hydraulic pump 15 to be connected to the pump suction pipeline 24 may be disposed on the left side of the second vertical plate 12.

The hydraulic oil tank 16 is disposed in a region in the front section S1 at a position closer to the second vertical plate 12 than the first vertical plate 11. Specifically, the hydraulic oil tank 16 is placed on the second vertical plate 12 in a state that a connected portion 16*a* of the hydraulic oil tank 16 to be connected to the pump suction pipeline 24 is disposed between the first vertical plate 11 and the second vertical plate 12.

Figure 3:
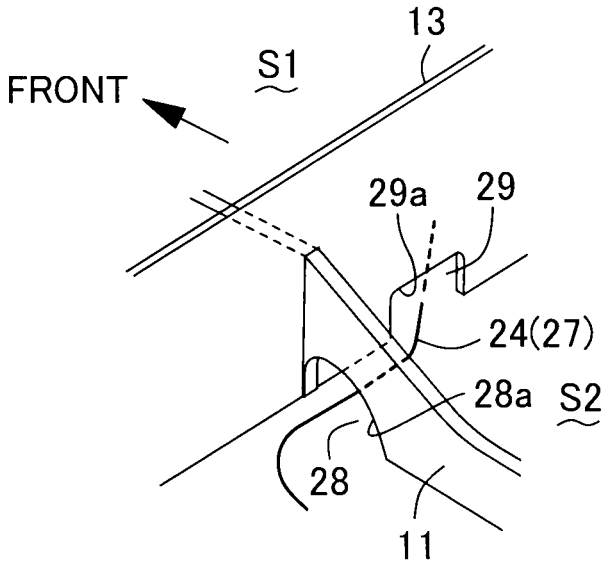
FIG. 3 is a perspective view of a partition plate and a vertical plate of the construction machine shown in FIG. 1, when viewed from the rear side of the construction machine.

Each of the first vertical plate 11 and the partition plate 13 is formed with a through-hole for passing the pump suction pipeline 24 to be described later therethrough. The first vertical plate 11 is formed with a vertical-plate-side through-hole 28 which passes through the first vertical plate 11 in the left and right directions within the rear section S2 and within the pump-front-side clearance D2. As shown in FIG. 3, the vertical-plate-side through-hole 28 has a semi-circular shape, and is formed in a lower portion of the first vertical plate 11 at a position immediately behind the partition plate 13. Specifically, the first vertical plate 11 is formed with a semi-circular through-hole-forming cutaway 28*a* which passes through the first vertical plate 11 in the left and right directions, and which is opened downward; and the vertical-plate-side through-hole 28 is formed between the through-hole-forming cutaway 28*a* and the top surface of the upper frame 7. On the other hand, the partition plate 13 is formed with a partition-plate-side through-hole 29 which passes through the partition plate 13 in the front and rear directions between the first vertical plate 11 and the second vertical plate 12, and at a position closer to the cabin 8 with respect to the center position in the left and right directions. The partition-plate-side through-hole 29 has a transversely long rectangular cross-sectional shape in accordance with the passing manner of the pump suction pipeline 24 to be described later, and is formed in a lower portion of the partition plate 13. Specifically, the partition plate 13 is formed with a transversely long rectangular through-hole-forming cutaway (elongate hole) 29*a* which passes through the partition plate 13 in the front and rear directions, and which is opened downward. The partition-plate-side through-hole 29 is formed between the through-hole-forming cutaway 29*a* and the top surface of the upper frame 7.

The pump suction pipeline 24 is disposed in such a manner that an intermediate portion of the pump suction pipeline 24 is bridgingly disposed between the front section S1 and the rear section S2 while passing through the vertical-plate-side through-hole 28 and the partition-plate-side through-hole 29. Specifically, the pump suction pipeline 24 is provided with a flexible pump-side hose 25 connected to the hydraulic pump 15, a flexible tank-side hose 26 connected to the hydraulic oil tank 16, and a non-flexible connection tube 27 (a metal pipe such as a steel pipe) which constitutes the intermediate portion of the pump suction pipeline 24 and connects between the hoses 25 and 26.

Next, the configuration of the pump suction pipeline 24 is described. The pump suction pipeline 24 includes a pump connecting portion 41*a* connected to the hydraulic pump 15, a vertical-plate passing portion 41*b* which is bent at a right angle at a front end of the pump connecting portion 41*a*, and a partition-plate passing portion 41*c* which is bent at an obtuse angle at a right end of the vertical-plate passing portion 41*b*. The pump connecting portion 41*a* extends forward from the hydraulic pump 15. The vertical-plate passing portion 41*b* is bent rightward at the front end of the pump connecting portion 41*a* within the pump-front-side clearance D2, and substantially perpendicularly intersects with the first vertical plate 11 through the vertical-plate-side through hole 28. The vertical-plate passing portion 41*b* extends to the interior of the engine-front-side clearance D1. The partition-plate passing portion 41*c* is bent forward at an obtuse angle at the right end of the vertical-plate passing portion 41*b*, and obliquely intersects with the partition plate 13 through the partition-plate-side through-hole 29. The partition-plate passing portion 41*c* is connected to the connected portion 16*a* of the hydraulic oil tank 16 in the front section S1.

In other words, the connection tube 27 serving as the intermediate portion of the pump suction pipeline 24 is bent at an obtuse angle into a wide U-shape or V-shape. One of the side portions (one of the linear portions) of the connection tube 27 with respect to a bending point of the connection tube 27 obliquely intersects with the partition plate 13 through the partition-plate-side through hole 29. Further, the other of the side portions (the other of the linear portions) of the connection tube 27 with respect to the bending point extends in parallel with the partition plate 13 or generally in parallel with the partition plate 13 (perpendicularly or generally perpendicularly intersects with the vertical plate 11) and passes through the vertical-plate-side through-hole 28.

The cover plate 30 is attached to the partition plate 13 by bolts 31 in a state that the partition-plate-side through-hole 29 is covered from the side of the front section S1. Specifically, the cover plate 30 is formed into a transversely long rectangular shape having a larger area than the area of the partition-plate-side through hole 29.

Figure 4:
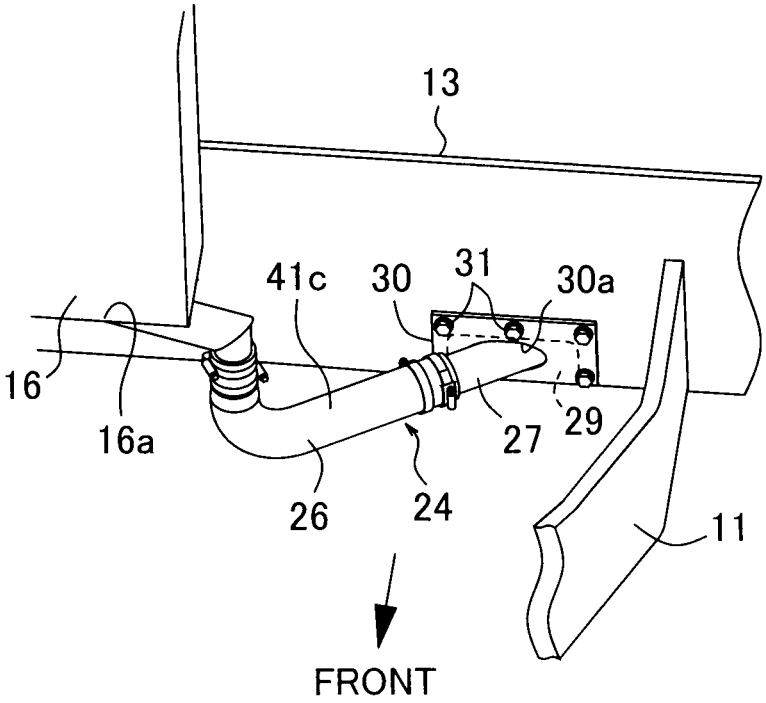
FIG. 4 is a perspective view of the partition plate of the construction machine shown in FIG. 1, when viewed from the front side of the construction machine.
Figure 5A:
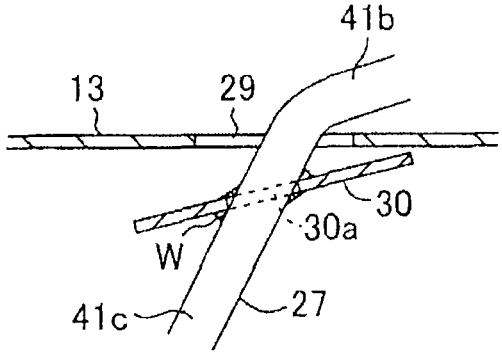
FIG. 5A is a cross-sectional plan view showing a state before a cover plate is attached to the partition plate.
Figure 5B:
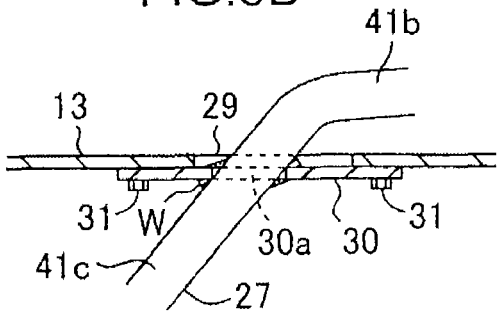
FIG. 5B is a cross-sectional plan view showing a state after the cover plate is attached to the partition plate.

Further, as shown in FIG. 4, FIG. 5A, and FIG. 5B, the cover plate 30 is fixed along the outer periphery of the connection tube 27. Specifically, the cover plate 30 has a transversely long elongate hole 30*a* for passing the connection tube 27, specifically, a portion (the partition-plate passing portion 41*c* which obliquely passes through the partition-plate-side through-hole 29) of the connection tube 27 therethrough. The cover plate 30 is fixed to the outer periphery of the passing portion of the connection tube 27 by welding in a state that the portion of the connection tube 27 is obliquely passed through the elongate hole 30*a*. In FIG. 5A and FIG. 5B, the symbol W indicates a welded portion of the cover plate 30.

A procedure of attaching the cover plate 30 is described. Firstly, as shown in FIG. 5A, the connection tube 27 attached with the cover plate 30 is passed through the partition-plate-side through-hole 29. Then, as shown in FIG. 5B, the orientation of the connection tube 27 is adjusted in such a direction that the cover plate 30 is aligned in parallel to the partition plate 13, and then, the cover plate 30 is fixed to the partition plate 13 by bolts.

With the above operation, the partition-plate-side through hole 29 is covered by the cover plate 30, and simultaneously, the connection tube 27 is supported by the cover plate 30.

In other words, the cover plate 30 also serves as a pipeline holder for supporting the pump suction pipeline 24.

In the above arrangement, it is possible to support the entirety of the pump suction pipeline 24 solely by the cover plate 30. Alternatively, the other portion of the pump suction pipeline 24 may be supported by a dedicated pipeline holder.

In the embodiment, the pump suction pipeline 24 is disposed along a path from the rear section S2 to the front section S1 without passing below the cabin. Accordingly, there is no or less likelihood that the interior of the cabin 8 may be directly affected by the heat or vibrations from the pump suction pipeline 24.

With the above arrangement, it is possible to improve the dwelling environment in the cabin 8.

Further, since the partition-plate-side through hole 29 is covered by the cover plate 30, it is possible to enhance the airtightness between the partition-plate-side through-hole 29 and the pump suction pipeline 24. Accordingly, it is possible to suppress transfer of heat of the engine 14 or a like member in the rear section S2 from the rear section S2 to the front section S1.

Further, as described above, the cover plate 30 also serves as a pipeline holder for supporting the pump suction pipeline 24. Accordingly, it is possible to eliminate the need of a dedicated pipeline holder, or reduce the number of parts. Thus, it is possible to enhance efficiency in a pipe laying operation, and realize cost reduction.

Furthermore, the cover plate 30 is welded to the outer periphery of the intermediate portion (passing portion) of the pump suction pipeline 24 in a state that the intermediate portion (the connection tube 27) of the pump suction pipeline 24 is obliquely passed through the cover plate 30. Accordingly, it is possible to increase a welding region by increasing the perimeter length of a welded portion (corresponding to the perimeter length of the inner surface of the through-hole (elongate hole 30*a*) of the cover plate 30, or corresponding to the perimeter length of the outer surface of the pump suction pipeline 24) between the cover plate 30 and the intermediate portion of the pump suction pipeline 24.

With the above arrangement, it is possible to enhance the attaching strength of the cover plate 30 with respect to the pump suction pipeline 24 to thereby enhance stability and durability in supporting the pump suction pipeline 24 by the cover plate 30.

In the above embodiment, the pump suction pipeline 24 has the partition-plate passing portion 41*c* which is bent at an obtuse angle at the right end of the vertical-plate passing portion 41*b*. Accordingly, it is possible to incline the partition-plate passing portion 41*c* with respect to the cover plate 30 in a state that the vertical-plate passing portion 41*b* is substantially perpendicularly passed through the first vertical plate 11.

In this embodiment, the vertical-plate-side through-hole 28 and the partition-plate-side through-hole 29 are formed at positions facing the engine-front-side clearance D1. Accordingly, it is possible to dispose the intermediate portion of the pump suction pipeline 24 which passes through the first vertical plate 11 and the partition plate 13 by utilizing the engine-front-side clearance D1.

In this embodiment, the pump-front-side clearance D2 is formed in addition to the engine-front-side clearance D1. Accordingly, it is possible to dispose the pump connecting portion 41*a*, and a portion of the vertical-plate passing portion 41*b* which is bent at the front end of the pump connecting portion 41*a* within the pump-front-side clearance D2. Further, it is possible to dispose the vertical-plate passing portion 41*b* passing through the first vertical plate 11, and a portion of the partition-plate passing portion 41*c* which is bent at the right end of the vertical-plate passing portion 41*b* within the engine-front-side clearance D1.

In this embodiment, the connected portion 16*a* of the hydraulic oil tank 16 is provided in a region between the first vertical plate 11 and the second vertical plate 12. Accordingly, it is possible to connect the pump suction pipeline 24 which is drawn to the front side of the partition plate 13 through the partition-plate-side through hole 29 to the hydraulic oil tank 16, without forming a through-hole in the second vertical plate 12.

In this embodiment, the vertical-plate-side through-hole 28 and the partition-plate-side through-hole 29 are formed between the top surface of the upper frame 7, and the vertical-plate-through-hole-forming cutaway 28*a* and the partition-plate-through-hole-forming cutaway 29*a*, respectively. Accordingly, it is possible to dispose the pump suction pipeline 24 in such a manner that the pump suction pipeline 24 extends along the top surface of the upper frame 7. With this arrangement, it is possible to dispose the pump suction pipeline 24, while avoiding interference with the other structures (such as other hydraulic pipeline) provided on the upper frame 7, as compared with an arrangement that both of the vertical-plate-side through-hole 28 and the partition-plate-side through-hole 29 are formed in an upper area with respect to the top surface of the upper frame 7.

Modifications (1) In the embodiment, a portion of the connection tube 27 which is bent at an obtuse angle is obliquely passed through the partition plate 13 (through the partition-plate-side through-hole 29). Alternatively, for instance, a portion of a connection tube 27 which is bent at a right angle and with a curvature may perpendicularly pass through the partition plate 13.

In the above modification, the partition-plate-side through-hole 29 may not be necessarily formed into an elongate hole.

(2) In the embodiment, the partition-plate-side through-hole 29 is formed at a position closer to the cabin 8 with respect to the center position in the left and right directions. Alternatively, the partition-plate-side through-hole 29 may be formed at a position closer to the hydraulic oil tank 16 with respect to the center position in the left and right directions.

(3) As far as the airtightness between the partition plate 13 and the pump suction pipeline 24 is not required, it is possible to omit the cover plate 30.

In the above modification, a pipeline holder in place of the cover plate 30 may be provided as pipeline holding means.

(4) The construction machine embodying the invention is not only applied to a hydraulic shovel, but also may be applied to other construction machines (such as a crusher or a demolition machine) incorporated with a hydraulic shovel as a main device.

The embodiment as described above mainly includes the invention having the following features.

A construction machine according to an aspect of the invention includes a lower propelling body; an upper frame which slewably mounted on the lower propelling body; a pair of a first vertical plate and a second vertical plate which are provided on the upper frame, the first vertical plate and the second vertical plate being disposed in left and right directions of the upper frame, and extending in front and rear directions of the upper frame; a partition plate which extends in the left and right directions and intersects with the first vertical plate and the second vertical plate in such a manner that a space above the upper frame is divided into a front section and a rear section; an engine which is provided along the left and right directions in the rear section; a hydraulic pump which is driven by the engine, at least a portion of the hydraulic pump being disposed in a region of the rear section opposite to the second vertical plate with respect to the first vertical plate; a cabin which is disposed in a region of the front section opposite to the second vertical plate with respect to the first vertical plate; a hydraulic oil tank which is provided in a region of the front section closer to the second vertical plate than the first vertical plate; and a pump suction pipeline which connects between the hydraulic pump and the hydraulic oil tank. In this arrangement, the first vertical plate is formed with a vertical-plate-side through-hole which passes through a portion of the first vertical plate in the rear section in the left and right directions, the partition plate is formed with a partition-plate-side through-hole which passes through a portion of the partition plate between the first vertical plate and the second vertical plate in the front and rear directions, and the pump suction pipeline is disposed between the front section and the rear section while passing through the vertical-plate-side through-hole and the partition-plate-side through-hole.

In the above arrangement, the construction machine is provided with a vertical-plate-side through-hole which passes through a portion of the first vertical plate in the rear section, and a partition-plate-side through-hole which passes through a portion of the partition plate between the first vertical plate and the second vertical plate. Further, in the above arrangement, the pump suction pipeline is bridgingly disposed between the front section and the rear section while intersecting with the first vertical plate and the partition plate through the vertical-plate-side through-hole and the partition-plate-side through-hole. Accordingly, it is possible to dispose the pump suction pipeline along a path from the rear section to the front section without passing below the cabin. This enables to suppress an influence of heat release and vibrations from the pump suction pipeline to the cabin to thereby improve the dwelling environment in the cabin.

Preferably, the construction machine may further include a cover plate which is provided on an outer periphery of an intermediate portion of the pump suction pipeline which passes through the partition-plate-side through-hole, wherein the cover plate is attached to the partition plate in a state that the partition-plate-side through-hole is covered.

In the above arrangement, the cover plate is provided on the outer periphery of the intermediate portion of the pump suction pipeline which passes through the partition-plate-side through-hole, and the cover plate is attached to the partition plate in a state that the partition-plate-side through-hole is covered. Accordingly, it is possible to enhance the airtightness between the inner surface of the partition-plate-side through hole, and the pump suction pipeline to thereby suppress transfer of heat of the engine or a like member from the rear section to the front section.

In the construction machine, preferably, the cover plate may be fixed to an outer periphery of the pump suction pipeline and attached to the partition plate in such a manner that the pump suction pipeline is supported.

In the above arrangement, the cover plate also serves as a pipeline holder for supporting the pump suction pipeline. Accordingly, it is possible to eliminate the need of a dedicated pipeline holder, or reduce the number of parts. Thus, the above arrangement enables to enhance the efficiency in a pipe laying operation, and realize cost reduction.

In the construction machine, preferably, the cover plate may be welded to the outer periphery of the intermediate portion of the pump suction pipeline in a state that the intermediate portion of the pump suction pipeline is obliquely passed through the cover plate.

In the above arrangement, the cover plate is welded to the outer periphery of the intermediate portion of the pump suction pipeline in a state that the intermediate portion of the pump suction pipeline is obliquely passed through the cover plate. Accordingly, it is possible to increase a welding region by increasing the perimeter length of a welded portion (corresponding to the perimeter length of the inner surface of the through-hole (elongate hole) of the cover plate, or corresponding to the perimeter length of the outer surface of the pump suction pipeline) between the cover plate and the intermediate portion of the pump suction pipeline.

With the above arrangement, it is possible to enhance the attaching strength of the cover plate with respect to the pump suction pipeline to thereby enhance stability and durability in supporting the pump suction pipeline by the cover plate.

Preferably, in the construction machine, the partition plate may extend in a direction substantially orthogonal to the first vertical plate, the pump suction pipeline may include a vertical-plate passing portion which substantially perpendicularly intersects with the first vertical plate through the vertical-plate-side through-hole, and a partition-plate passing portion which is bent at an obtuse angle at an end of the vertical-plate passing portion, and which obliquely intersects with the partition plate through the partition-plate-side through-hole, and the cover plate may be welded to an outer periphery of the partition-plate passing portion.

In the above arrangement, the pump suction pipeline includes a vertical-plate passing portion which is bent at an obtuse angle at an end of the vertical-plate passing portion. Accordingly, it is possible to incline the partition-plate passing portion with respect to the cover plate in a state that the vertical-plate passing portion is substantially perpendicularly passed through the first vertical plate.

Preferably, the construction machine may further include an engine-front-side clearance which is formed between the engine and the partition plate, wherein the vertical-plate-side through-hole and the partition-plate-side through-hole are respectively formed at positions facing the engine-front-side clearance.

In the above arrangement, the vertical-plate-side through-hole and the partition-plate-side through-hole are respectively formed at positions facing the engine-front-side clearance. Accordingly, it is possible to dispose the intermediate portion of the pump suction pipeline which passes through the first vertical plate and the partition plate by utilizing the engine-front-side clearance.

Preferably, the construction machine may further include a pump-front-side clearance which is formed between the hydraulic pump and the partition plate, wherein the pump suction pipeline includes a pump connecting portion which extends forward from the hydraulic pump toward the pump-front-side clearance, a vertical-plate passing portion which is bent at an end of the pump connecting portion within the pump-front-side clearance, and which extends to the interior of the engine-front-side clearance while passing through the first vertical plate, and a partition-plate passing portion which is bent at an end of the vertical-plate passing portion within the engine-front-side clearance, and which passes through the partition plate.

In the above arrangement, the pump-front-side clearance is formed in addition to the engine-front-side clearance. Accordingly, it is possible to dispose the pump connecting portion and a portion of the vertical-plate passing portion which is bent at an end of the pump connecting portion within the pump-front-side clearance. Further, it is possible to dispose the vertical-plate passing portion passing through the first vertical plate, and a portion of the partition-plate passing portion which is bent at an end of the vertical-plate passing portion within the engine-front-side clearance.

In the construction machine, preferably, the hydraulic oil tank may include a connected portion connected to the pump suction pipeline, and the connected portion of the hydraulic oil tank may be provided in a region between the first vertical plate and the second vertical plate.

In the above arrangement, the connected portion of the hydraulic oil tank is provided in the region between the first vertical plate and the second vertical plate. Accordingly, it is possible to connect the pump suction pipeline which is drawn to the front side of the partition plate through the partition-plate-side through hole to the hydraulic oil tank, without forming a through-hole in the second vertical plate.

In the construction machine, preferably, each of the first vertical plate and the partition plate may be formed with a through-hole-forming cutaway which passes through the first vertical plate and the partition plate, and which is opened downward, and the vertical-plate-side through-hole and the partition-plate-side through-hole may be respectively formed between a top surface of the upper frame, and the respective through-hole-forming cutaways.

In the above arrangement, the vertical-plate-side through-hole and the partition-plate-side through-hole are respectively formed between a top surface of the upper frame, and the respective through-hole-forming cutaways. Accordingly, it is possible to dispose the pump suction pipeline in such a manner that the pump suction pipeline extends over the top surface of the upper frame. With this arrangement, it is possible to dispose the pump suction pipeline while avoiding interference with the other structures (such as other hydraulic pipeline) provided on the upper frame, as compared with an arrangement that both of the vertical-plate-side through hole and the partition-plate-side through hole are formed in an upper region with respect to the top surface of the upper frame.

This application is based on Japanese Patent Application No. 2010-062016 filed on Mar. 18, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A construction machine, comprising:

a lower propelling body;

an upper frame which is slewably mounted on the lower propelling body;

a pair of a first vertical plate and a second vertical plate which are provided on the upper frame, the first vertical plate and the second vertical plate being disposed in left and right directions of the upper frame, and extending in front and rear directions of the upper frame;

a partition plate which extends in the left and right directions and intersects with the first vertical plate and the second vertical plate in such a manner that a space above the upper frame is divided into a front section and a rear section;

an engine which is provided along the left and right directions in the rear section;

a hydraulic pump which is driven by the engine, at least a portion of the hydraulic pump being disposed in a region of the rear section opposite to the second vertical plate with respect to the first vertical plate;

a cabin which is disposed in a region of the front section opposite to the second vertical plate with respect to the first vertical plate;

a hydraulic oil tank which is provided in a region of the front section closer to the second vertical plate than the first vertical plate; and a pump suction pipeline which connects between the hydraulic pump and the hydraulic oil tank, wherein the first vertical plate is formed with a vertical-plate-side through-hole which passes through a portion of the first vertical plate in the rear section in the left and right directions, the partition plate is formed with a partition-plate-side through-hole which passes through a portion of the partition plate between the first vertical plate and the second vertical plate in the front and rear directions, the pump suction pipeline is disposed between the front section and the rear section while passing through the vertical-plate-side through-hole and the partition-plate-side through-hole, and the pump suction pipeline includes a portion disposed between the vertical-plate-side through-hole and the partition-plate-side through-hole in a region of the rear section between the first vertical plate and the second vertical plate.

2. The construction machine according to claim 1, further comprising a cover plate which is provided on an outer periphery of an intermediate portion of the pump suction pipeline which passes through the partition-plate-side through-hole, wherein the cover plate is attached to the partition plate in a state that the partition-plate-side through-hole is covered.

3. The construction machine according to claim 2, wherein the cover plate is fixed to an outer periphery of the pump suction pipeline and attached to the partition plate in such a manner that the pump suction pipeline is supported.

4. The construction machine according to claim 3, wherein the cover plate is welded to the outer periphery of the intermediate portion of the pump suction pipeline in a state that the intermediate portion of the pump suction pipeline is obliquely passed through the cover plate.

5. The construction machine according to claim 1, further comprising an engine-front-side clearance which is formed between the engine and the partition plate, wherein the vertical-plate-side through-hole and the partition-plate-side through-hole are respectively formed at positions facing the engine-front-side clearance.

6. The construction machine according to claim 1, wherein the hydraulic oil tank includes a connected portion connected to the pump suction pipeline, and the connected portion of the hydraulic oil tank is provided in a region between the first vertical plate and the second vertical plate.

7. The construction machine according to claim 1, wherein each of the first vertical plate and the partition plate is formed with a through-hole-forming cutaway which passes through the first vertical plate and the partition plate, and which is opened downward, and the vertical-plate-side through-hole and the partition-plate-side through-hole are respectively formed between a top surface of the upper frame, and the respective through-hole-forming cutaways.

8. A construction machine comprising:

a lower propelling body;

an upper frame which is slewably mounted on the lower propelling body;

a pair of a first vertical plate and a second vertical plate which are provided on the upper frame, the first vertical plate and the second vertical plate being disposed in left and right directions of the upper frame, and extending in front and rear directions of the upper frame;

a partition plate which extends in the left and right directions and intersects with the first vertical plate and the second vertical plate in such a manner that a space above the upper frame is divided into a front section and a rear section;

an engine which is provided along the left and right directions in the rear section;

a hydraulic pump which is driven by-the engine, at least a portion of the hydraulic pump being disposed in a region of the rear section opposite to the second vertical plate with respect to the first vertical plate;

a cabin which is disposed in a region of the front section opposite to the second vertical plate with respect to the first vertical plate;

a hydraulic oil tank which is provided in a region of the front section closer to the second vertical plate than the first vertical plate;

a pump suction pipeline which connects between the hydraulic pump and the hydraulic oil tank; and a cover plate which is provided on an outer periphery of an intermediate portion of the pump suction pipeline which passes through the partition-plate-side through-hole, wherein the first vertical plate is formed with a vertical-plate-side through-hole which passes through a portion of the first vertical plate in the rear section in the left and right directions, the partition plate is formed with a partition-plate-side through-hole which passes through a portion of the partition plate between the first vertical plate and the second vertical plate in the front and rear directions, the pump suction pipeline is disposed between the front section and the rear section while passing through the vertical-plate-side through-hole and the partition-plate-side through-hole, the cover plate is attached to the partition plate in a state that the partition-plate-side through-hole is covered, the cover plate is fixed to an outer periphery of the pump suction pipeline and attached to the partition plate in such a manner that the pump suction pipeline is supported, the cover plate is welded to the outer periphery of the intermediate portion of the pump suction pipeline in a state that the intermediate portion of the pump suction pipeline is obliquely passed through the cover plate, the partition plate extends in a direction substantially orthogonal to the first vertical plate, the pump suction pipeline includes a vertical-plate passing portion which substantially perpendicularly intersects with the first vertical plate through the vertical-plate-side through-hole, and a partition-plate passing portion which is bent at an obtuse angle at an end of the vertical-plate passing portion, and which obliquely intersects with the partition plate through the partition-plate-side through-hole, and the cover plate is welded to an outer periphery of the partition-plate passing portion.

9. A construction machine, comprising:

a lower propelling body;

an upper frame which is slewably mounted on the lower propelling body;

a pair of a first vertical plate and a second vertical plate which are provided on the upper frame, the first vertical plate and the second vertical plate being disposed in left and right directions of the upper frame, and extending in front and rear directions of the upper frame;

a partition plate which extends in the left and right directions and intersects with the first vertical plate and the second vertical plate in such a manner that a space above the upper frame is divided into a front section and a rear section;

an engine which is provided along the left and right directions in the rear section;

a hydraulic pump which is driven by the engine, at least a portion of the hydraulic pump being disposed in a region of the rear section opposite to the second vertical plate with respect to the first vertical plate;

a cabin which is disposed in a region of the front section opposite to the second vertical plate with respect to the first vertical plate;

a hydraulic oil tank which is provided in a region of the front section closer to the second vertical plate than the first vertical plate;

a pump suction pipeline which connects between the hydraulic pump and the hydraulic oil tank;

an engine-front-side clearance which is formed between the engine and the partition plate; and a pump-front-side clearance which is formed between the hydraulic pump and the partition plate, wherein the first vertical plate is formed with a vertical-plate-side through-hole which passes through a portion of the first vertical plate in the rear section in the left and right directions, the partition plate is formed with a partition-plate-side through-hole which passes through a portion of the partition plate between the first vertical plate and the second vertical plate in the front and rear directions, the pump suction pipeline is disposed between the front section and the rear section while passing through the vertical-plate-side through-hole and the partition-plate-side through-hole, the vertical-plate-side through-hole and the partition-plate-side through-hole are respectively formed at positions facing the engine-front-side clearance, the pump suction pipeline includes a pump connecting portion which extends forward from the hydraulic pump toward the pump-front-side clearance, a vertical-plate passing portion which is bent at an end of the pump connecting portion within the pump-front-side clearance, and which extends to the interior of the engine-front-side clearance while passing through the first vertical plate, and a partition-plate passing portion which is bent at an end of the vertical-plate passing portion within the engine-front-side clearance, and which passes through the partition plate.

* * * * *